United States Patent [19]

Hitomi et al.

[11] 4,427,499

[45] Jan. 24, 1984

[54] PROCESS FOR SURFACE TREATMENT OF STAINLESS STEEL SHEET

[75] Inventors: Tomoge Hitomi, Ageo; Takehisa Konishi, Kawasaki; Tetsutaro Ogushi; Kazuaki Hatakeyama, both of Tokyo, all of Japan

[73] Assignee: Nippon Kinzoku Co., Ltd., Tokyo, Japan

[21] Appl. No.: 288,183

[22] Filed: Jul. 29, 1981

[30] Foreign Application Priority Data

Jun. 4, 1981 [JP] Japan ..... 56-85952

[51] Int. Cl.[3] ..... C25D 11/36; C25D 11/38

[52] U.S. Cl. ..... 204/27; 204/40; 204/56 R

[58] Field of Search ..... 204/145 R, 27, 28, 34, 204/56 R, 40, 140

[56] References Cited

U.S. PATENT DOCUMENTS 3,118,824 1/1964 Yonezaki et al. ..... 204/56
3,247,086 4/1966 Goldstein et al. ..... 204/140
3,287,237 11/1966 Wilton ..... 204/140
3,531,384 9/1970 Inouye et al. ..... 204/56
4,071,416 1/1978 Sutton ..... 204/38 R
4,213,792 7/1980 Marianeschi et al.

FOREIGN PATENT DOCUMENTS

1563979 United Kingdom
1482546 United Kingdom
1437762 United Kingdom
1365111 United Kingdom

*Primary Examiner*—G. L. Kaplan
*Assistant Examiner*—William Leader

[57] ABSTRACT

A process for surface treatment of stainless steel sheets for excellent corrosion resistance and gloss is provided according to which a BA film or a passive film is formed on the stainless steel sheet; the sheet is dipped in a treatment solution containing 0.1 to 50% by weight of phosphoric acid, 0.1 to 10.0% by weight of a molybdate, chromic acid or a mixture thereof, and 0.1 to 2.0% by weight of magnesium oxide, sodium silicate or a mixture thereof; and cathodic treatment is carried out under the conditions of 1 to 600 A.sec/dm$^2$ integrated electric current density and 0° to 90° C. solution temperature.

11 Claims, No Drawings

PROCESS FOR SURFACE TREATMENT OF STAINLESS STEEL SHEET

BACKGROUND OF THE INVENTION

The present invention relates to a process for surface treatment of a stainless steel sheet (including a stainless steel strip) according to which electro-chemical treatment is performed using the stainless steel sheet as a cathode for forming a noncorroding film on the surface thereof.

Chrome plating is known as a process for surface treatment of this type. Chrome plating is a kind of electroplating according to which a surface film of pure chrome is formed on the surface of the stainless steel sheet by electrodeposition of metal chrome. This surface film is advantageous in that it is noncorroding and has excellent gloss. This film is utilized for treating stainless steel sheets which are inexpensive but are not sufficiently noncorroding, such as sheets according to JIS SUS430.

However, this chrome plating adopts as a treatment solution a mixture of sulfuric acid and chromic acid of high concentration. For this reason, the waste solution from the treatment contains a large amount of chromic acid and thus requires costly treatment for prevention of pollution.

Chrome plating further requires a large current of over several amperes per $dm^2$ and a long treatment time. This plating process thus results in great power consumption (e.g., integrated current density 6,000 A.-sec/$dm^2$) and higher treatment cost.

In view of these problems, it has been proposed, as an alternative to chrome plating, to perform an electrochemical treatment using a mixture of chromic acid, dichromic acid and phosphoric acid as a treatment solution, and a stainless steel sheet as a cathode for forming a noncorroding film on the surface of the stainless steel sheet.

This process is advantageous in that the concentration of residual chromic acid in the solution is low, and the treatment of the waste solution is easy. Furthermore, a corrosion resistance comparable to that obtained with chromic plating may be obtained with a smaller current density and a shorter conduction time.

However, this process has drawbacks in that resistance to sulfurous acid which is essential in stainless steel sheets for automobiles is poor, and surface gloss is poor, thus reducing the product value as compared with chrome-plated stainless steel sheets.

SUMMARY OF THE INVENTION

The present invention has been made in view of this and has for its object to provide a process for surface treatment of a stainless steel sheet wherein the treatment solution is improved so that gloss and resistance to sulfurous acid are improved.

According to a first aspect of the present invention, there is provided a process for surface treatment of a stainless steel sheet characterized by dipping a stainless steel sheet having a BA (bright annealing) film or a passive film in a treatment solution and carrying out cathodic treatment under conditions of 1 to 600 A.-sec/$dm^2$ integrated current density and 10° to 90° C. solution temperature, said treatment solution containing 0.1 to 50.0% by weight of phosphoric acid, 0.1 to 1.0% by weight of chromic acid, and 0.1 to 2% by weight of a member selected from the group consisting of magnesium oxide, sodium silicate, and mixtures thereof.

According to a second aspect of the present invention, there is provided a process for surface treatment of a stainless steel sheet characterized by dipping a stainless steel sheet having a BA film or a passive film in a treatment solution containing 0.1 to 70% by weight of phosphoric acid and 0.1 to 10.0% by weight of a molybdate, and carrying out cathodic treatment under the conditions of 1 to 600 A.sec/$dm^2$ integrated current density and 10°to 90° C. solution temperature.

According to a third aspect of the present invention, there is provided a process for surface treatment of a stainless steel sheet characterized by, before or after dipping a stainless steel having a BA film or a passive film in a first treatment solution containing 0.1 to 50.0% by weight phosphoric acid, 0.1 to 10.0% by weight of chromic acid, and 0.1 to 2.0% by weight of a member selected from the group consisting of magnesium oxide, sodium silicate and mixtures thereof and carrying out cathodic treatment under the conditions of 1 to 600 A.sec/$dm^2$ integrated density and 0° to 9020 C. solution temperature, dipping the stainless sheet in a second treatment solution containing 0.1 to 70% by weight of phosphoric acid and 0.1 to 10% by weight of a molybdate and carrying out cathodic treatment under the conditions of 1 to 600 A.sec/$dm^2$ integrated current density and 10° to 90° C. solution temperature.

According to a fourth aspect to the present invention, there is provided a process for surface treatment of a stainless steel sheet characterized by dipping a stainless steel sheet having a BA film or a passive film in a treatment solution containing 0.1 to 50.0% by weight of phosphoric acid, 0.1 to 10.0% by weight of chromic acid, 0.1 to 2.0% by weight of a member selected from the group consisting of magnesium oxide, sodium silicate and mixtures thereof, and 0.1 to 10.0% by weight of a molybdate, and carrying out cathodic treatment under the conditions of 1 to 600 A.sec/$dm^2$ integrated current density and 10° to 90° C. solution temperature.

DETAILED DESCRIPTION OF THE INVENTION

Before practicing the present invention, a BA (bright annealing) film or a passive film must be formed on the surface of the stainless steel sheet to be treated. The BA film or the passive film is a film which renders the surface of the stainless steel sheet inactive. The BA film may be obtained by bright heat-treatment according to which the sheet is heated in a vacuum, an inert gas, a reducing gas, or a hot salt. The passive film may be obtained by leaving to the sheet in air or dipping the stainless steel sheet in a 20% (by volume) aqueous solution of nitric acid at room temperature for 30 minutes or at 65° C. for 10 minutes.

The reason why the BA film or the passive film should be formed before the treatment according to the present invention is that if such a film is not formed in advance, corrosion resistance may not be improved even if cathodic treatment is conducted according to this invention. This has been confirmed by experiments to be described later (Example 1).

As has been described above, according to the first aspect of the present invention, a stainless steel sheet having a BA film or a passive film formed thereon undergoes cathodic treatment in a treatment solution containing phosphoric acid, chromic acid, magnesium oxide and/or sodium silicate.

Phosphoric acid and chromic acid contained in this treatment solution are necessary components for forming a noncorroding film on the surface of the stainless steel sheet. The lower limit of the amount of phosphoric acid to be used has been set at 0.1% by weight since with smaller amounts of phosphoric acid, satisfactory corrosion resistance may not be obtained. The upper limit of phosphoric acid to be used has also been set to 50% by weight, since larger amount of phosphoric acid result in loss of gloss at the surface of the stainless steel sheet and a greater waste of solution. The preferable range of the amount of phosphoric acid to be used herein is 5 to 20% by weight.

The range for the amount of chromic acid has also been set between 0.1 and 10.0% by weight for the same reason as in the case of phosphoric acid. When the amount of chromic acid is not in this range, satisfactory corrosion resistance may not be obtained. When the amount of chromic is out of this range, surface gloss is lost and the amount of the waste solution will be great. The preferable range of the amount of chromic acid is 0.5 to 1.8% by weight.

Magnesium oxide and sodium silicate are components for preventing loss of gloss at the surface of the stainless steel sheet. The range of the amount of magnesium oxide has been limited since satisfactory gloss may not be obtained below 0.1% or above 2.0% by weight. The preferable range of the amount of magnesium oxide is 0.5 to 1.5% by weight.

The amount of sodium silicate has been limited between 0.1 and 2% by weight. When this amount is less than 0.1% by weight, satisfactory gloss may not be obtained. When the amount of sodium silicate exceeds 2% by weight, it precipitates in the form of gel from the solution, so that it may not exhibit the advantageous effects of sodium silicate. The preferable range of sodium silicate is 0.1 to 0.8% by weight. The amounts of magnesium oxide or sodium silicate have been limited to within the range of 0.1 to 2% by weight. When the amount of either of these is below 0.1% by weight, the satisfactory effects provided by addition of these members may not be obtained. When the amount exceeds 2% by weight, the surface gloss may not be obtained. The preferable range of the amount of magnesium oxide or sodium silicate is 1.0 to 1.8% by weight.

The treating conditions for cathodic treatment in such a treatment solution are 1 to 600 A.sec/dm$^2$ integrated current density and 0° to 90° C. solution temperature. The integrated current density has been limited to the range of 1 to 600 A.sec/dm$^2$ since a lower integrated current density than 1 A.sec/dm$^2$ results in insufficient corrosion resistance and a higher integrated current density than 600 A.sec/dm$^2$ results in unsatisfactory surface gloss and higher cost. The preferable range of integrated current density is 60 to 360 A.sec/dm$^2$. The solution temperature has been limited to the range of 0° to 90° C. since the solution temperature below 0° C. results in a longer treating time and difficulty in maintaining the temperature of the treatment solution; a higher solution temperature than 90° C. results in degradation in quality of the treatment solution. The preferable range of solution temperature is 50° to 70° C.

According to the second aspect of the present invention, a stainless steel sheet with a BA film or a passive film formed thereon undergoes cathodic treatment or dipping treatment in a treatment solution containing phosphoric acid and molybdate.

The phosphoic acid contained in this treatment solution is a necessary component for forming a noncorroding film on the surface of the stainless steel sheet as in the case of the first aspect of the present invention. The lower limit of the amount of phosphoric acid has been set to 0.1% by weight since a smaller amount of phosphoric acid results in unsatisfactory corrosion resistance. The upper limit of phosphoric acid has been set to 70% by weight since larger amount results in loss of surface gloss at the surface of the stainless steel sheet and a greater solution loss. The preferable range of the amount of phosphoric acid is 5 to 50% by weight.

The molybdate is effective in improving resistance to sulfurous acid by forming the corrosion resistant film on the surface of the stainless steel sheet and in maintaining excellent gloss. The molybdate may be included in the form of ammonium molybdate, sodium molybdate and so on. The amount of the molybdate to be used herein has been set as described above since a smaller amount of the molybdate does not provide satisfactory effects and a larger amount results in loss of surface gloss. The preferable range of the amount of the molybdate is 1 to 3% by weight.

The treating conditions for this treatment are the same as those as have been described with reference to the first aspect of the present invention except that the lower limit of the solution temperature may be lowered to 0° C. in this case.

The third aspect of the present invention provides three options:

(a) a process for carrying out cathodic treatment of a stainless steel sheet having BA film or passive film formed thereon under predetermined conditions with a solution mixture (first treatment solution) containing phosphoric acid, chromic acid, and magnesium oxide and/or sodium silicate; and thereafter carrying out again cathodic treatment under predetermined conditions with a solution mixture (second treatment solution) containing phosphoric acid and a molybdate;

(b) a process of carrying out cathodic treatment of a stainless steel sheet having a BA film or a passive film formed thereon under predetermined conditions with a solution mixture (second treatment solution) containing phosphoric acid and a molybdate; and thereafter carrying out again cathodic treatment under predetermined conditions with a solution mixture (first treatment solution) containing phosphoric acid, chromic acid, and magnesium oxide and/or sodium silicate; and (c) a process for carrying out cathodic treatment in a solution mixture (solution mixture of the first and second treatment solutions) containing phosphoric acid, chromic acid, the molybdate, and magnesium oxide and/or sodium silicate.

Among these three options, the best effects are obtained with the first method (a).

The mixing ratio of the respective components in the first treatment solution is the same as that described before with reference to the first aspect of the present invention. Similarly, the mixing ratio of the respective components of the second treatment solution is the same as that described with reference to the second aspect of the present invention. The cathodic treatment conditions in the first treatment solution are 1 to 600 A.sec/dm$^2$ in integrated current density, and 0° to 90° C. in solution temperature, preferably 10° to 30° C. The integrated current density has been limited to this range for the reasons as described below. When the integrated current density is below 1 A.sec/dm$^2$, the gloss may be maintained but the resistance to corrosion, such as resistance to sulfurous acid, salt damage (table 1) and so on, is not satisfactory. When the integrated current density exceeds 600 A.sec/dm$^2$, the gloss may not be maintained and the process is uneconomical. Particularly for improving the resistance to sulfurous acid, it is preferable to set the integrated current density within the range of 40 to 120 A.sec/dm$^2$. Particularly for improving the resistance to salt damage, it is preferable to set the integrated current density of 10 to 80 A.sec/dm$^2$. For improving both these resistance characteristics, it is preferable to set the integrated current density within the range of 50 to 70 A.sec/dm$^2$. The temperature of this treatment solution should be controlled between 0° and 90° C. for the reasons to be described below. When the solution temperature is below 0° C., the treatment time becomes longer and maintenance of the temperature of treatment solution becomes difficult. When the solution temperature exceeds 90° C., the effects of improving resistance to corrosion may not be obtained. In the cathodic protection with the first treatment solution, the treatment time may be shortened and the power consumption may be reduced with an increase in temperature of the treatment solution. With a solution temperature ranging from 70° to 90° C., a film of sufficient corrosion resistance may be formed on the surface of the stainless steel sheet with an integrated current density of below 1 A.sec/dm$^2$, or even at 0 A.sec/dm$^2$ (dipping in the solution with no electric current flowing through the stainless steel sheet).

The cathodic treatment conditions in the second treatment solution are 1 to 600 A.sec/dm$^2$ integrated current density, and 10° to 90° C. solution temperature, preferably 40° to 60° C. The integrated current density has been set within the range of 1 to 600 A.sec/dm$^2$ for the reasons to be described below. When the integrated current density is below 1 A.sec/dm$^2$, the gloss may be maintained but the corrosion resistance may not be sufficient. When the integrated current density exceeds 600 A.sec/dm$^2$, the surface gloss may not be obtained, discoloration may occur, and the process is uneconomical. Particularly for improving the resistance to sulfurous acid, it is preferable to set the integrated current density within the range of 60 to 200 A.sec/dm$^2$. Particularly for improving the resistance to salt damage, it is preferable to set the integrated current density within the range of 40 to 80 A.sec/dm$^2$. For improving both these resistances, the integrated current density is preferably set within the range of 60 to 80 A.sec/dm$^2$. The solution temperature of the second treatment solution has been set to be within the range of 0° to 90° C. for the same reasons described with reference to the second aspect of the present invention.

As for the cathodic treatment in the second treatment solution, the treatment time may be shortened and the power consumption may be reduced with a higher solution temperature. With a solution temperature ranging from 70° to 90° C., a corrosion resistant film may be formed on the surface of the stainless steel sheet with an integrated current density of below 1 A.sec/dm$^2$, or even at 0 A.sec/dm$^2$ (dipping in the solution with no electric current flowing through the stainless steel sheet).

The cathodic treatment conditions with a solution mixture of the first and second treatment solutions may be substantially the same as those described with reference to the cathodic treatment with either the first or second treatment solution, and may be appropriately selected accordingly.

According to the present invention, the treatment time may be shortened with a higher solution temperature and a greater current density. With the treatment solution and the treatment conditions according to the present invention, a corrosion resistant film may be formed, generally, in 10 seconds to 10 minutes.

In accordance with the present invention, a film having corrosion resistance may be formed on the surface of a stainless steel sheet, and its corrosion resistance will not be degradated for a long period of time after treatment. This film is rich in gloss and improves the resistance to corrosion of a stainless steel sheet having insufficient resistance to corrosion, thus improving its product value.

EXAMPLE 1

As raw materials, stainless steel sheets (or strip) of JIS SUS 430 (No. 1), JIS SUS 434 (No. 2), and JIS SUS 304 (No. 3) having on their surface BA film formed by bright annealing were used. The treatment solution contained 9.25% by weight of phosphoric acid, 1.68% by weight of chromic acid, 0.7% by weight of magnesium oxide, and 0.10% by weight of sodium silicate.

The stainless steel sheets were subjected to cathodic treatment for 3 minutes at a current density of 2.0 A/dm$^2$ and a solution temperature of 20° C.

The surface-treated stainless steel sheets were then subjected to a corrosion resistance test according to the conditions shown in Table 1. The obtained results are shown in Table 2.

For the purpose of comparison, a conventional stainless steel sheet having simply a BA film formed thereon, i.e. without carrying out the catholic treatment according to this invention, was also subjected to the corrosion test according to the method shown in Table 1, and the obtained results are also shown in Table 2.

A stainless steel sheet without a BA or passive film formed thereon was subjected to the cathodic treatment under the same conditions as in the example described above. The corrosion test results of this material are also shown in Table 2.

The example described above, another treatment solution containing phosphoric acid and chromic acid but not containing magnesium oxide and sodium silicate was similarly used for surfce treatment. The results of the corrosion tests on the stainless steel sheet obtained with this treatment solution are also shown in Table 2.

TABLE 1

| Test item | Solution | Test temperature | Method of spraying or application | Sample size | Test time | Sample setting | Adjustment of sample |
|---|---|---|---|---|---|---|---|
| SS (JISZ 2371) (ASTM B 287-62) | NaCl 5 ± 1% pH 6.5 (Adjusted with hydrochloric acid or sodium hydroxide) | 35 ± 2° C. | Mean sprayed amount after operation for 16 hrs 1.5 ± 0.5 ml/80 cm$^2$ · hr | 70 mm × 150 mm | 96 hrs | Inclined 15° against normal line | Washing with water ~ Alkali degreasing ~ Washing with water |

TABLE 1-continued

| Test item | Solution | Test temperature | Method of spraying or application | Sample size | Test time | Sample setting | Adjustment of sample |
|---|---|---|---|---|---|---|---|
| CaSS (JISD 0201) (ASTM B 368-65) | NaCl 5 ± 1% CuCl: 211.0 0.26 g/l pH 3.1 (Adjusted with glacial acetic acid) | 49 ± 2° C. | Mean sprayed amount after operation for 16 hrs 1.5 ± 0.5 ml/ 80 $cm^2$ · hr | 70 mm × 150 mm | 16 hrs and 96 hrs | Inclined 15° against normal line | Washing with water~ Alkali degreasing~ Washing with water |
| Dip & Dry (GM standard) | $H_2O$ 2100 ml, NaCl 105 g, $Na_2SO_4$ 1 g, $Na_2SO_3$ 0.5 g, $Na_2S_2O_3$ 0.2 g, $CaCl_2.2H_2O$ 105 g } pH 9.3 | 32–43° C. 43–53° C. | cycle of: → Dip 2 sec → Dry 100 sec | 30 mm × 150 mm | 100 cycles | Vertical | Washing with water~ Alkali degreasing~ Washing with water |
| Thermo-graphic | Same as above | 110° C. Humidity 100% | Photographic paper dipped in solution is adhered to sample | 70 mm × 150 mm | 10 min | Horizon-tal | Washing with water~ Alkali degreasing~ Washing with water |
| Corrode coat (JISD 0201) | $\frac{25\ g}{500\ ml}$ · $Cu(NO_3)_2.3H_2O$ 7 ml; $\frac{25\ g}{500\ ml}$ · $FeCl_3.6H_2O$ 33 ml; $\frac{50\ g}{500\ ml}$ · $NH_4Cl$ 10 ml; Kaolin 30 g | 38 ± 2° C. | Paste of composition at left is applied with brush | 70 mm × 150 mm | 16 hrs | Inclined 15° with respect to normal line | Washing with water~ Alkali degreasing~ Washing with water |
| Sulfurous acid gas (DIN 50018) | 2.0 l of $SO_2$ gas is sealed in a chamber of 300 l capacity | 40 ± 3° C. | Kept within the atmos-phere | 70 mm × 150 mm | Placed in $SO_2$ gas atmos-phere for 8 hrs Left to stand for 16 hrs after opening chamber | Vertical | Washing with water~ Alkali degreasing~ Washing with water |

TABLE 2

| | Sample | Rusted area SS | CaSS 16 hrs | CaSS 96 hrs | Dip & Dry | Thermo-graphic | Corrode coat | Sulfurous acid gas |
|---|---|---|---|---|---|---|---|---|
| Example | SUS 430 *A treating material | 0 | 0 | 2.0 | 16.1 | 30.0 | 12.0 | 87.2 |
| Comparative Example | SUS 430 BA film alone | 0 | 0 | 16.1 | 100 | 100 | 57.0 | 100 |
| | Cathodic treat-ment of raw material without BA film | 0 | 0 | 15.0 | 100 | 100 | 15.0 | 100 |
| | Cathodic treat-ment with solution not containing magnesium oxide or sodium silicate | 0 | 0 | 2.1 | 17.2 | 30.0 | 15.0 | 100 |
| Example | SUS 434 *A treating material | 0 | 0 | 0 | 1.7 | 0 | 20.0 | — |
| Comparative Example | SUS 434 BA film alone | 0 | 0 | 0 | 1.7 | 14.5 | 93.0 | 80.0 |

*A treating material treated with the first treatment solution

EXAMPLE 2

The gloss of the surface of the stainless steel sheets obtained in Example 1 was compared with the gloss of the stainless steel sheets having the BA film formed thereon. The presence or absence of gloss was evaluated. The obtained results are shown in Table 3.

For the purpose of comparison, the same evaluations were made on stainless steel sheets treated with the treatment solutions wherein the amounts of phosphoric acid, chromic acid, magnesium oxide and sodium silicate deviated from the ranges according to the present invention, and on stainless steel sheets obtained at integrated current densities which deviated from the ranges according to the present invention. The obtained results are shown in Table 3.

TABLE 3

| | | Solution composition (% by weight) | | | | Treating conditions | | | |
|---|---|---|---|---|---|---|---|---|---|
| | | Phosphoric acid | Chromic acid | Magnesium oxide | Sodium silicate | Current density (A/dm$^2$) | Solution temperature (°C.) | Treatment time (min) | Gloss |
| Example | | 10 | 2 | 1.0 | 0 | 2 | 25 | 3 | o |
| | | 10 | 2 | 0 | 1.0 | 2 | 25 | 3 | o |
| | | 9.25 | 16.8 | 0.78 | 0.1 | 2 | 25 | 3 | o |
| Comparative Example | Deviated solution composition | 2.0 | 2 | 2.5 | 0 | 2 | 25 | 3 | x |
| | | 2 | 15 | 1.0 | 0 | 2 | 25 | 3 | x |
| | Deviated in integral current density | 10 | 2 | 1.0 | 0 | 10 | 25 | 3 | x |

o Good gloss
x Poor gloss

EXAMPLE 3

Stainless steel sheet raw materials were used which were obtained by bright annealing the sheets according to JIS SUS 430, JIS SUS 434, and JIS SUS 420J2 to form BA films, and by hair-line treating (forming a passive film on) the sheet according to JIS SUS 304. The treatment solution contained 9.37% by weight of phosphoric acid and 1.34% by weight of sodium molybdate.

These stainless steel sheets were subjected to cathodic treatment in this treatment solution under the conditions of a current density of 1.0 A/dm$^2$, a solution temperature of 20° C., and a treatment time of 3 minutes (treatment 1). These stainless steel sheets were then subjected to cathodic treatment again at a current density of 1.0 A/dm$^2$, a solution temperature of 50° C., and a treatment time of 30 seconds (treatment 2).

The stainless steel sheets surface-treated in this manner then underwent the corrosion resistance test shown in Table 1, and the obtained results are shown in Table 4.

For the purpose of comparison, a stainless steel sheet having a BA film formed thereon was similarly subjected to the corrosion resistance test and the obtained results are shown in Table 4.

A stainless steel sheet having neither the BA film nor the passive film was subjected to cathodic protection under the same conditions as in this example. The obtained results are also shown in Table 4.

A stainless steel sheet as in the above example was similarly subjected to cathodic treatment with a treatment solution which contained phosphoric acid but which did not contain a molybdate. The results of the corrosion resistance test on this stainless steel sheet are also shown in Table 4.

TABLE 4

| | Sample | Proportion of rusted area (%) Test: Dip and Dry | Sulfurous acid gas |
|---|---|---|---|
| Example | SUS 430 Treatment 1 | 16.1 | 0 |
| | SUS 430 Treatment 2 | 3.0 | 0 |
| Comparative Example | SUS 430 Raw material | 100 | 100 |
| | SUS 430 Treatment 1 without film | 70.0 | 100 |
| | SUS 430 Treatment 1 with solution not containing molybdate | 21.0 | 100 |
| Example | SUS 434 Treatment 1 | 0 | 0 |
| Comparative Example | SUS 434 Raw material | 1.7 | 80 |
| Example | SUS 420J2 Treatment 1 | 20.0 | 20.0 |
| Comparative Example | SUS 420J2 Raw material | 100 | 100 |
| Example | SUS 304 Treatment 1 (hair-line) | 0 | 0 |
| Comparative Example | SUS 304 Raw material (hair-line) | 15.0 | 18.0 |

EXAMPLE 4

The surface gloss of the stainless steel sheet (JIS SUS 430) obtained in Example 3 was compared with that of the stainless steel sheel having the BA film formed thereon. The presence or absence of gloss was evaluated. The obtained results are shown in Table 5.

For the purpose of comparison, evaluations were made on the presence or absence of gloss on the stainless steel sheets obtained with the treatment solutions wherein the amounts of phosphoric acid and molybdate deviated from the ranges according to the present invention, and on the stainless steel sheets obtained at current densities which deviated from the ranges according to the present invention. The obtained results are also shown in Table 5.

TABLE 5

| | Solution composition (% by weight) | | Treating conditions | | | |
|---|---|---|---|---|---|---|
| | Phosphoric acid | Molybdate | Current density (A/dm$^2$) | Solution temperature (°C.) | Treatment time | Gloss |
| Example | 5.0 | 1.0 | 2 | 25 | 3 | o |
| | 40.0 | 0.5 | 1 | 50 | 1 | o |

TABLE 5-continued

| | | Solution composition (% by weight) | | Treating conditions | | | |
|---|---|---|---|---|---|---|---|
| | | Phosphoric acid | Molybdate | Current density (A/dm²) | Solution temperature (°C.) | Treatment time | Gloss |
| | | 40.0 | 1 | 0 | 80 | 1 | o |
| Comparative Example | Deviated solution composition | 80 | 1 | 1 | 25 | 1 | x |
| | | 20 | 15 | 1 | 25 | 1 | x |
| | Deviated in integrated current density | 5 | 1 | 12 | 25 | 1 | x |
| | | 40 | 0.5 | 12 | 25 | 1 | x |

o Good gloss,
x Poor gloss

EXAMPLE 5

Stainless steel sheets were used which were obtained by bright annealing sheets according to JIS SUS 430 to form BA films thereon. The first treatment solution contained 9.25% by weight of phosphoric acid, 1.68% by weight of chromic acid, 0.78% by weight of magnesium oxide, and 0.10% by weight of sodium silicate. The stainless steel sheets were subjected to cathodic treatment by varying the treatment conditions within the ranges according to the present invention. The second treatment solution contained 9.37% by weight of phosphoric acid and 1.34% by weight of sodium molybdate. The stainless steel sheets were subjected to cathodic treatment again by varying the treatment conditions within the ranges according to the present invention.

The stainless steel sheets surface-treated in this manner were subjected to the corrosion resistance test according to the method shown in Table 1 (the resistance to sulfurous acid was evaluated according to the sulfurous acid gas corrosion test as defined in Dln, and the resistance to salt damage was evaluated according to the Dip and Dry method (GM conditions)). The obtained results are shown in Table 6. Observations were made on gloss and discoloration of the surfaces of the sheets, and the obtained results are also shown in Table 6.

For the purpose of comparison, stainless steel sheets were subjected to various treatment methods. Some stainless steel sheets were subjected to the first and second treatments wherein the treatment conditions deviated from the ranges according to the present invention (Nos. 9 to 12). A stainless steel sheet was subjected to cathodic treatment in the first treatment solution but not to the second treatment (No. 13). Stainless steel sheets were subjected to the first treatment but not to the second treatment (Nos. 14 and 15). A stainless steel sheet which did not have a BA film was subjected to the first and second treatments (No. 16). A stainless steel sheet was subjected to the second treatment first and to the first treatment thereafter (No. 17). A stainless steel sheet was subjected to a treatment with a solution mixture of the first and second treatment solutions (No. 18). These stainless steel sheets were subjected to the corrosion resistance test and were evaluated for gloss and discoloration. The results are shown in Table 6.

In the case of sample No. 18, the composition of the solution mixture was 9.37% by weight of phosphoric acid, 1.68% by weight of chromic acid, 0.78% by weight of magnesium oxide, and 1.34% by weight of a molybdate. The treatment conditions were 1 A/dm² current density, 60 second treatment time, and 50° C. solution temperature.

For the purpose of comparison, stainless steel sheets were subjected to dipping (without conduction of current) instead of cathodic treatment in the first and second treatment solutions (Nos. 19 to 21). These stainless steel sheets were subjected to the corrosion resistance test and were evaluated for gloss and discoloration. The results are shown in Table 6.

TABLE 6

| | | Treating conditions | | | | Test Results | | |
|---|---|---|---|---|---|---|---|---|
| | | First treatment solution | | Second treatment solution | | Corrosion resistance | | |
| | | Solution temperature (°C.) | Integrated current density (A · sec/cm²) | Solution temperature (°) | Integrated current density (A · sec/cm²) | Dip and Dry | Sulfurous acid gas (%) | Surface texture |
| Example | No. 1 | 20 | 20 | 50 | 30 | 0 | 1.1 | Same as sheet with BA film |
| | No. 2 | 20 | 45 | 50 | 55 | 0 | 2.0 | Same as sheet with BA film |
| | No. 3 | 20 | 70 | 50 | 85 | 0 | 0.2 | Same as sheet with BA film |
| | No. 4 | 20 | 40 | 60 | 45 | 0 | 0.1 | Same as sheet with BA film |
| | No. 5 | 20 | 45 | 60 | 50 | 1.8 | 1.2 | Same as sheet with BA film |
| | No. 6 | 20 | 70 | 60 | 80 | 1.0 | 0.1 | Same as sheet with BA film |
| | No. 7 | 20 | 65 | 70 | 75 | 3.0 | 0.3 | Same as sheet with BA film |
| | No. 8 | 20 | 125 | 70 | 115 | 3.2 | 0.1 | Same as sheet with BA film |

TABLE 6-continued

| | | Treating conditions | | | | Test Results | | |
|---|---|---|---|---|---|---|---|---|
| | | First treatment solution | | Second treatment solution | | Corrosion resistance | | |
| | | Solution temperature (°C.) | Integrated current density (A · sec/cm²) | Solution temperature (°) | Integrated current density (A · sec/cm²) | Dip and Dry | Sulfurous acid gas (%) | Surface texture |
| Comparative Example | No. 9 | *100 | 60 | 50 | 60 | 0 | 75 | Same as sheet with BA film |
| | No. 10 | 20 | *720 | 50 | 60 | 0 | 60 | Same as sheet with BA film |
| | No. 11 | 20 | 60 | *100 | 60 | 0.1 | 0.5 | Changed markedly to yellow |
| | No. 12 | 20 | 60 | 50 | *720 | 2.0 | 0 | Changed markedly to blue |
| Example | No. 13 | 50 | 120 | | | 16.1 | 87.2 | Same as sheet with BA film |
| | No. 14 | | | 50 | 60 | 2.1 | 0.2 | Changed slightly to yellow |
| | No. 15 | | | 50 | 180 | 10.5 | 0 | Changed slightly to blue |
| | No. 16 | 20 | 60 | 50 | 60 | 6.0 | 1.5 | Changed slightly to blue |
| Example | No. 17 | 20 | 60 | 50 | 60 | 11.2 | 25.0 | Changed slightly to blue |
| | No. 18 | (Solution mixture of first and second treatment solutions) | | | | 0.2 | 65 | Changed slightly to blue |
| Reference Example | No. 19 | 40 | 0 | 50 | 60 | 3.5 | 1.1 | Same as sheet with BA film |
| | No. 20 | 40 | 60 | 50 | 0 | 0 | 10.5 | Same as sheet with BA film |
| | No. 21 | 40 | 0 | 50 | 0 | 25 | 30 | Same as sheet with BA film |

*Numbers marked with * indicate conditions deviating from ranges of present invention In summary, according to the process of the present invention, corrosion resistance, particularly resistance to sulfurous acid, is excellent and excellent gloss may be maintained, providing an excellent process for surface treatment of stainless steel sheets for automobiles. With the process of the present invention, preparation for the treatment is easy and degradation in the treatment solution may be prevented for a long period of time.

What we claim is:

1. A process for surface treatment of a stainless steel sheet comprising dipping a stainless steel sheet having a bright annealing film or a passive film in a treatment solution and carring out cathodic treatment under conditions of 1 to 600 A-sec/dm² integrated current density and 0° to 90° C. solution temperature, said treatment solution containing 0.1 to 50.0% by weight of phosphoric acid, 0.1 to 10.0% by weight of chronic acid, and 0.1 to 2% by weight of sodium silicate.

2. A process according to claim 1, wherein the treatment solution contains 5 to 20% by weight of phosphoric acid, 0.5 to 1.8% by weight of chromic acid, and 0.1 to 0.8% by weight of sodium silicate.

3. A process according to claim 1, wherein the treatment solution contains 0.1 to 10.0% by weight of a molybdate.

4. A process for surface treatment of a stainless steel sheet comprising dipping a stainless steel sheet having a bright annealing film or a passive film in a treatment solution and carrying out cathodic treatment under conditions of 1 to 600 A-sec/dm² integrated current density and 0° to 90° C. solution temperature, said treatment solution containing 0.1 to 70.0% by weight of phosphoric acid and 0.1 to 10.0% by weight of a molybdate.

5. A process according to claim 4, wherein the treatment solution contains 5 to 50% by weight of phosphoric acid and 1 to 3% by weight of the molybdate.

6. A process for surface treatment of a stainless steel sheet by dipping such a sheet having a bright annealing film or a passive film in a treatment solution and carrying out cathodic treatment thereof comprising the steps of performing said cathodic treatment in two steps, the first step comprising dipping a stainless steel sheet having a bright annealing film or a passive film in a treatment solution containing 0.1 to 50.0% by weight of phosphoric acid, 0.1 to 10.0% by weight of chromic acid, and 0.1 to 2.0% by weight of a member selected from the group consisting of magnesium oxide, sodium silicate and mixtures thereof and carrying out cathodic treatment under the conditions of 1 to 600 A-sec/dm² integrated current density and 0° to 90° C. solution temperature, and a second step comprising dipping the stainless steel sheet treated in the first step in a treatment solution containing 0.1 to 70% by weight of phosphoric acid and 0.1 to 10.0% by weight of a molybdate and carrying out cathodic treatment under the conditions of 1 to 600 A-sec/dm² integrated current density and 10° to 90° C. solution temperature.

7. A process according to claim 6, wherein the treatment solution in the first step contains 5 to 20% by weight of phosphoric acid, 0.5 to 1.8% by weight of chromic acid, and 0.5 to 1.5% by weight of a member selected from the group consisting of magnesium oxide, sodium silicate and mixtures thereof, and the treatment solution in the second step contains 5 to 50% by weight of phosphoric acid and 1 to 3% of the molybdate.

8. A process for surface treatment of a stainless steel sheet by dipping such a sheet having a bright annealing film or a passive film in a treatment solution and carrying out cathodic treatment thereof comprising the steps of performing said cathodic treatment in two steps, the first step comprising dipping a stainless steel sheet having a bright annealing film or a passive film in a treatment solution containing 0.1 to 70% by weight of phosphoric acid and 0.1 to 10.0% by weight of a molybdate and carrying out cathodic treatment under the conditions of 1 to 600 A-sec/dm$^2$ integrated current density and 10° to 90° C. solution temperature, and a second step comprising dipping the stainless steel sheet treated in the first step in a treatment solution containing 0.1 to 50.0% by weight of phosphoric acid, 0.1 to 10.0% by weight of chromic acid, and 0.1 to 2.0% by weight of a member selected from the group consisting of magnesium oxide, sodium silicate and mixtures thereof and carrying out cathodic treatment under the conditions of 1 to 600 A-sec/dm$^2$ integrated current density and 0°to 90° C. solution temperature.

9. A process according to claim 8, wherein the treatment solution in the first step contains 5 to 50% by weight of phosphoric acid and 1 to 3% by weight of the molybdate, and the treatment solution in the second step contains 5 to 20% by weight of phosphoric acid, 0.5 to 1.8% by weight of chromic acid, and 0.5 to 1.5% by weight of a member selected from the group consisting of magnesium oxide, sodium silicate and mixtures thereof.

10. A process according to any one of claims 1 to 5, wherein the integrated current density is 60 to 360 A-sec/dm$^2$ and the solution temperature is 50°~70° C.

11. A process according to any one of claims 1 to 9, wherein the stainless steel sheet conforms to JIS SUS 430, JIS SUS 420g2 or JIS SUS 434.

* * * * *